US008413301B2

(12) United States Patent
Fang

(10) Patent No.: US 8,413,301 B2
(45) Date of Patent: Apr. 9, 2013

(54) UNIVERSAL BOX LID LIFTER

(75) Inventor: Shih-Hao Fang, Hangzhou (CN)

(73) Assignee: Wellsco International Group Co., Ltd., Hangzhou (CN)

( * ) Notice: Subject to any disclaimer, the term of this patent is extended or adjusted under 35 U.S.C. 154(b) by 235 days.

(21) Appl. No.: 13/007,695

(22) Filed: Jan. 17, 2011

(65) Prior Publication Data

US 2012/0102676 A1 May 3, 2012

(30) Foreign Application Priority Data

Oct. 28, 2010 (CN) ..... 2010 2 0581713 U

(51) Int. Cl.
*E05F 1/08* (2006.01)

(52) U.S. Cl.
USPC ..... 16/286; 16/287; 16/302; 220/830

(58) Field of Classification Search ..... 16/286–289, 16/291, 366, 368–370, 282, 294, 302, 85, 16/DIG. 10; 220/817, 830; 217/60 B, 60 E; 312/325, 327; 292/263
See application file for complete search history.

(56) References Cited

U.S. PATENT DOCUMENTS 829,385 A * 8/1906 Brennan, Jr. ..... 217/60 E
1,424,550 A * 8/1922 Aschburner ..... 217/60 E
2,205,682 A * 6/1940 Claud-Mantle ..... 217/60 E
2,269,251 A * 1/1942 Carson ..... 217/60 E
2,483,947 A * 10/1949 Turner ..... 217/60 C
2,527,933 A * 10/1950 Jakeway ..... 217/60 E
2,903,149 A * 9/1959 Turner ..... 217/60 E
3,093,258 A * 6/1963 Turner ..... 217/60 E
3,203,575 A * 8/1965 Anderson et al. ..... 220/830

* cited by examiner

*Primary Examiner* — William L. Miller
(74) *Attorney, Agent, or Firm* — Alan Kamrath; Kamrath IP Lawfirm, P.A.

(57) ABSTRACT

A universal box lid lifter has an upper mounting plate, an upper connection piece, a pivoting arm, a spring housing, a spring assembly, a lower connection piece and a lower mounting plate. The upper connection piece has two ends oriented in two directions and is pivotally mounted between the upper mounting plate, with the pivoting arm respectively pivotable in two directions. The spring assembly is mounted in the spring housing and abuts against the pivoting arm and alternately positions the pivoting arm. The lower connection piece has two ends oriented in two directions and is pivotally mounted between the lower mounting plate, with the spring housing respectively pivotable in two directions. Given the bidirectionally pivotable mechanism at both ends of the universal box lid lifter, the universal box lid lifters of a single type can be flexibly mounted to a box as requested to lift the lid of the box.

16 Claims, 7 Drawing Sheets

UNIVERSAL BOX LID LIFTER

BACKGROUND OF THE INVENTION

1. Field of the Invention

The present invention relates to a lid lifter and, more particularly, to a universal box lid lifter capable of being mounted on different locations of a lid and a base of a box for lifting and closing the lid.

2. Description of the Related Art

Boxes made of durable materials, such as metal and wood, are useful in storing things. Basically, a box has a lid and a base. In order to store or access items inside the base, the lid needs to be lifted and held in a lifted position without interfering with a user's act of storing or accessing the items. Hence, box lid lifters are brought into play to support the lid in the lifted position and close the lid on an opening of the base.

With reference to FIG. 7, a conventional left box lid lifter 80 and a conventional right box lid lifter 80' are mounted on an inner wall of the lid 91 and respectively on two opposite inner walls of a base 92 of a box 90 to keep the lid 91 lifted. Each of the conventional left box lid lifter 80 and the conventional right box lid lifter 80' has an upper mounting plate 81, a pivoting arm 82, a spring housing 83, and a lower mounting plate 84. The upper mounting plate 81 is pivotally mounted on one end of the pivoting arm 82. The lower mounting plate 84 is pivotally mounted on one end of the spring housing 83. The upper mounting plates 81 and the lower mounting plates 84 of the conventional left box lid lifter 80 and the conventional right box lid lifter 80' are pivotable respectively in one direction. Due to the difference in mounting positions, the upper mounting plates 81 of the conventional left box lid lifter 80 and the conventional right box lid lifter 80' are mounted oppositely on the respective pivoting arms 82. Similarly, the lower mounting plates 84 of the conventional left box lid lifter 80 and the conventional right box lid lifter 80' are mounted oppositely on the respective spring housing 83. Accordingly, to lift and close a lid of a box 90, a single type of conventional box lid lifters is inadequate to do the job, and at minimum, one left box lid lifter 80 and one right box lid lifter 80' are required. To address a simpler and universal box lid lifter that can be mounted on various locations in a box, the conventional box lid lifters 80, 80' have to be further improved.

SUMMARY OF THE INVENTION

An objective of the present invention is to provide a universal box lid lifter capable of being mounted on different locations of a lid and a base of a box for lifting and closing the lid.

To achieve the foregoing objective, the universal box lid lifter has an upper mounting plate, an upper connection piece, a pivoting arm, a spring housing, a spring assembly, a lower connection piece and a lower mounting plate.

The upper connection piece has two ends oriented in two directions. One end of the upper connection piece is pivotally mounted on the upper mounting plate.

The pivoting arm has a first end and a second end. The first end is pivotally mounted on the other end of the upper connection piece.

The spring housing has a first end and a second end. The first end is movably mounted on the second end of the pivoting arm.

The spring assembly is mounted in the spring housing, abuts against, and alternately positions the second end of the pivoting arm.

The lower connection piece has two ends oriented in two directions. One end of the lower connection piece is pivotally mounted on the second end of the spring housing.

The lower mounting plate is pivotally mounted on the other end of the lower connection piece.

As the upper connection piece is bidirectionally pivotable with respect to the upper mounting plate and the pivoting arm and as the lower connection piece is bidirectionally pivotable with respect to the lower mounting plate and the spring housing, the universal box lid lifter can be flexibly mounted on various positions in a box, thus eliminating the need of multiple box lid lifters mounted between a lid and a base of a box for lifting and closing the lid.

Other objectives, advantages and novel features of the invention will become more apparent from the following detailed description when taken in conjunction with the accompanying drawings.

DETAILED DESCRIPTION OF THE INVENTION

Figure 1:
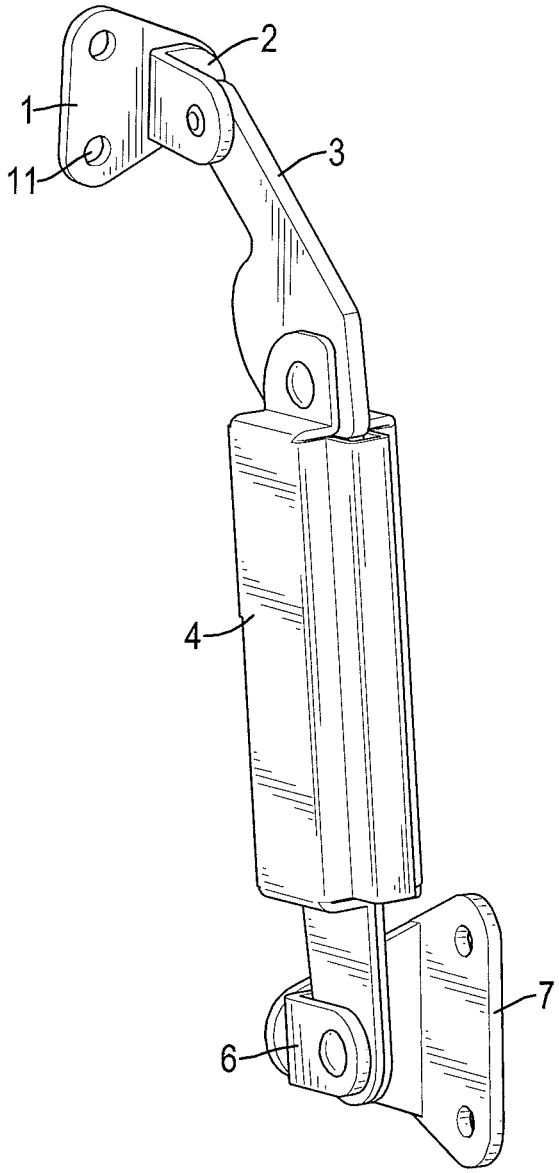
FIG. 1 is a perspective view of a universal box lid lifter in accordance with the present invention.
Figure 2:
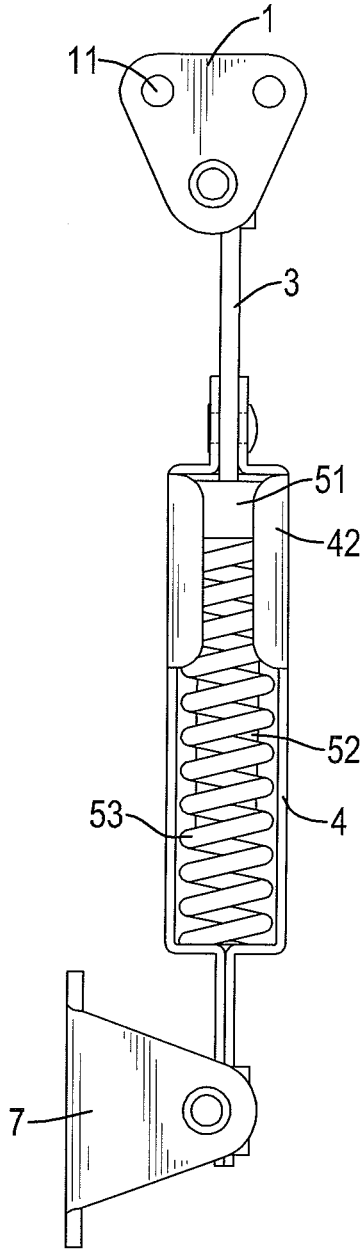
FIG. 2 is a rear view of the universal box lid lifter in FIG. 1.
Figure 3:
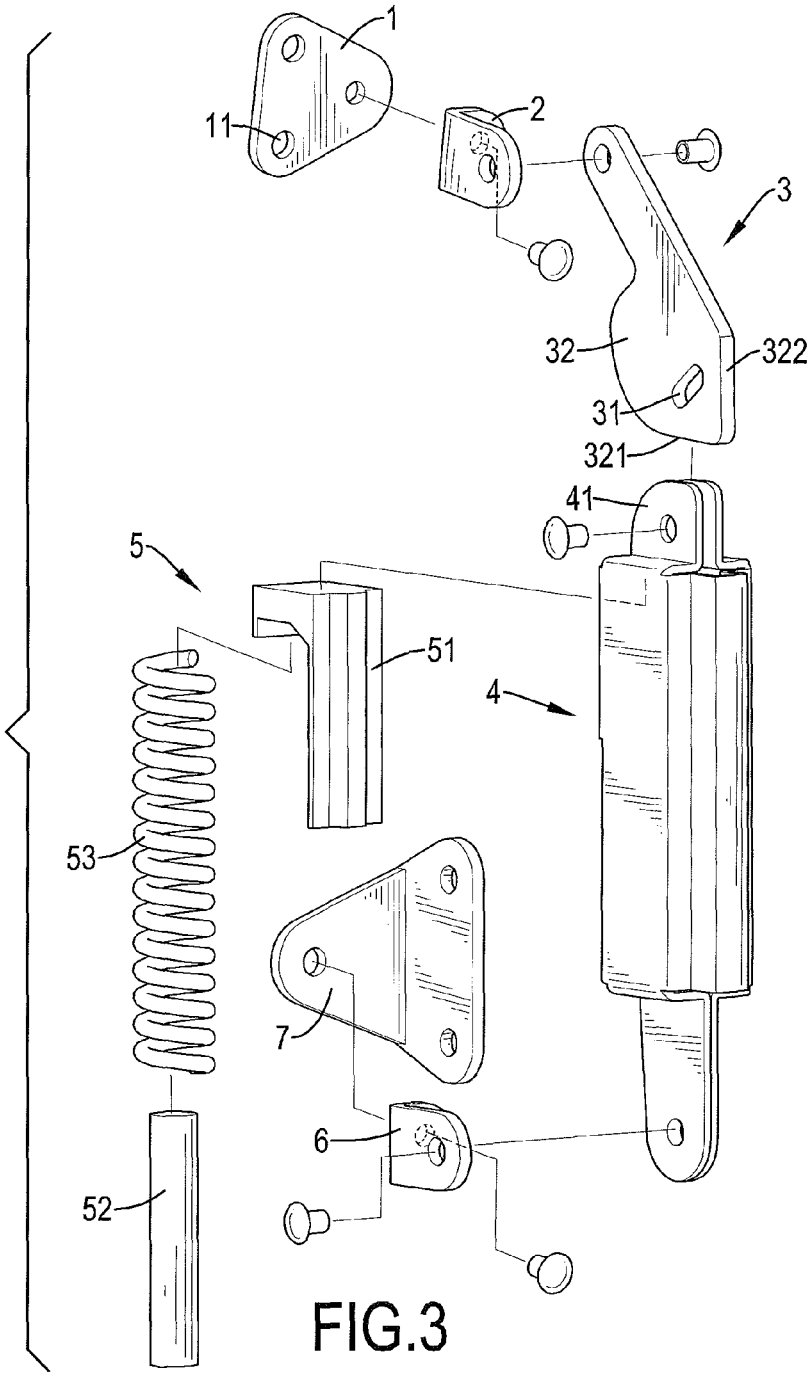
FIG. 3 is an exploded perspective view of the universal box lid lifter in FIG. 1.

With reference to FIGS. 1 to 3, a universal box lid lifter in accordance with the present invention has an upper mounting plate 1, an upper connection piece 2, a pivoting arm 3, a spring housing 4, a spring assembly 5, a lower connection piece 6 and a lower mounting plate 7.

The upper mounting plate 1 has multiple threaded holes 11 formed through the upper mounting plate 1. The upper connection piece 2 is L-shaped. One end of the upper connection piece 2 is pivotally mounted on the upper mounting plate 1. A first end of the pivoting arm 3 is pivotally mounted on the other end of the upper connection piece 2. As two ends of the upper connection piece 2 are oriented in two different directions, the upper mounting plate 1 and the pivoting arm 3 can be pivoted with respect to each other in two different directions. The pivoting arm 3 has a sliding slot 31 and a positioning portion 32. The sliding slot 31 is formed through a second end of the pivoting arm 3. The positioning portion 32 is formed on the second end of the pivoting arm 3 and has a lifting edge 321 and a closing edge 322. An included angle defined by the lifting edge 321 and the closing edge 322 may be but is not limited to 90°. The spring housing 4 has an open side, two ears 41 and two fences 42. The ears 41 are parallelly formed on and protruding from a first end of the spring housing 4. The fences 42 are formed on two edges of the spring housing 4 and extend toward each other. The positioning portion 32 of the pivoting arm 3 is movably mounted between the ears 41 of the spring housing 4 through the sliding slot 31 so that the pivoting arm 3 can be slidably moved along the sliding slot 31 with respect to the first end of the spring housing 4.

The spring assembly 5 is mounted in the spring housing 4, is blocked by the fences 42 to prevent from coming off from the open side, and has a spring stop 51, a positioning rod 52 and a compression spring 53. When the pivoting arm 3 is pivoted, a first side of the spring stop 51 alternately abuts against the lifting edge 321 and the closing edge 322 of the pivoting arm 3 for respectively positioning the pivoting arm 3 in a lid-open state and a lid-closed state. The positioning rod 52 is securely connected with a second side of the spring stop 51. The spring stop 51 may be L-shaped. The compression spring 53 is mounted around the positioning rod 52. One end of the compression spring 53 abuts against the second side of the spring stop 51. The other end of the compression spring 53 abuts against a bottom of an inner wall of the spring housing 4. The compression force exerted by the compression spring 53 pushes the spring stop 51 to abut against one of the lifting edge 321 and the closing edge 322 of the pivoting arm 3 so that the pivoting arm 3 can be securely connected with the spring stop 51.

The lower connection piece 6 is L-shaped. One end of the lower connection piece 6 is pivotally mounted on a second end of the spring housing 4. The lower mounting plate 7 is pivotally mounted on the other end of the lower connection piece 6, and has multiple threaded holes 71 formed through the lower mounting plate 7. As two ends of the lower connection piece 6 are oriented in two different directions, the lower mounting plate 7 and the spring housing 4 can be pivoted with respect to each other in two different directions.

Figure 4:
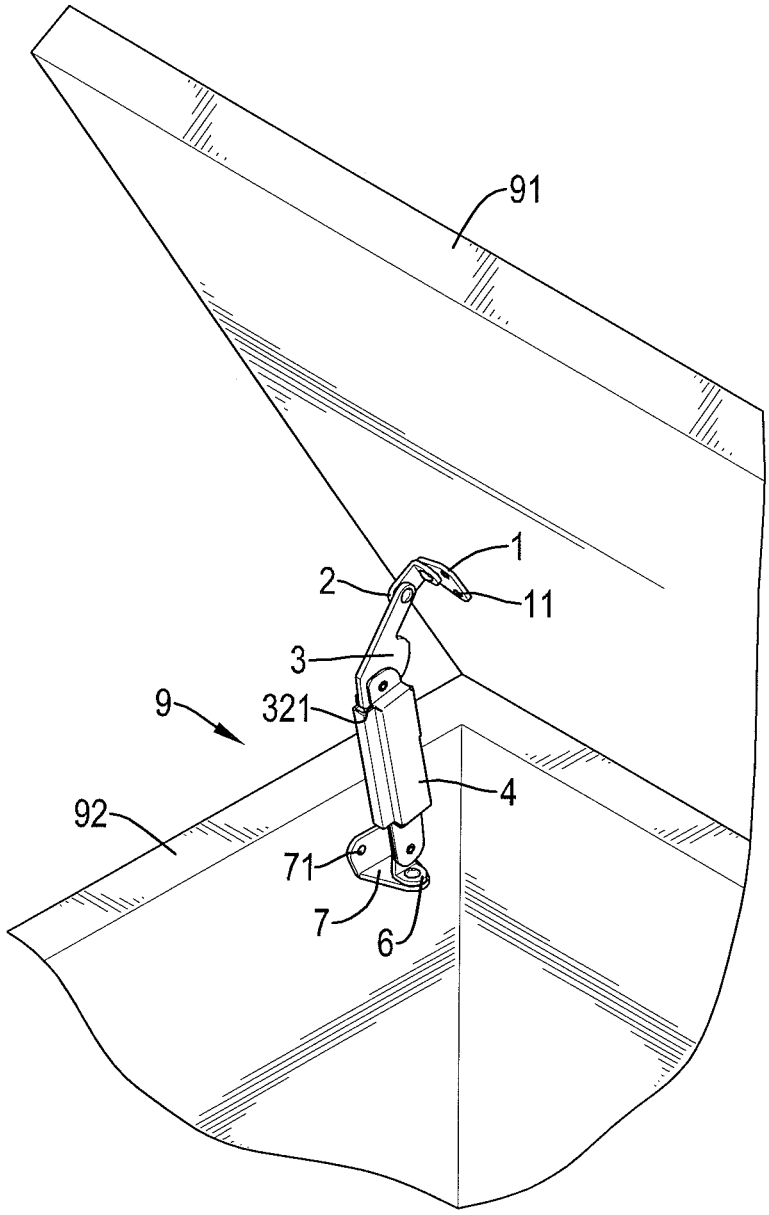
FIG. 4 is an operational perspective view of the universal box lid lifter in FIG. 1, shown mounted in a box.
Figure 5:
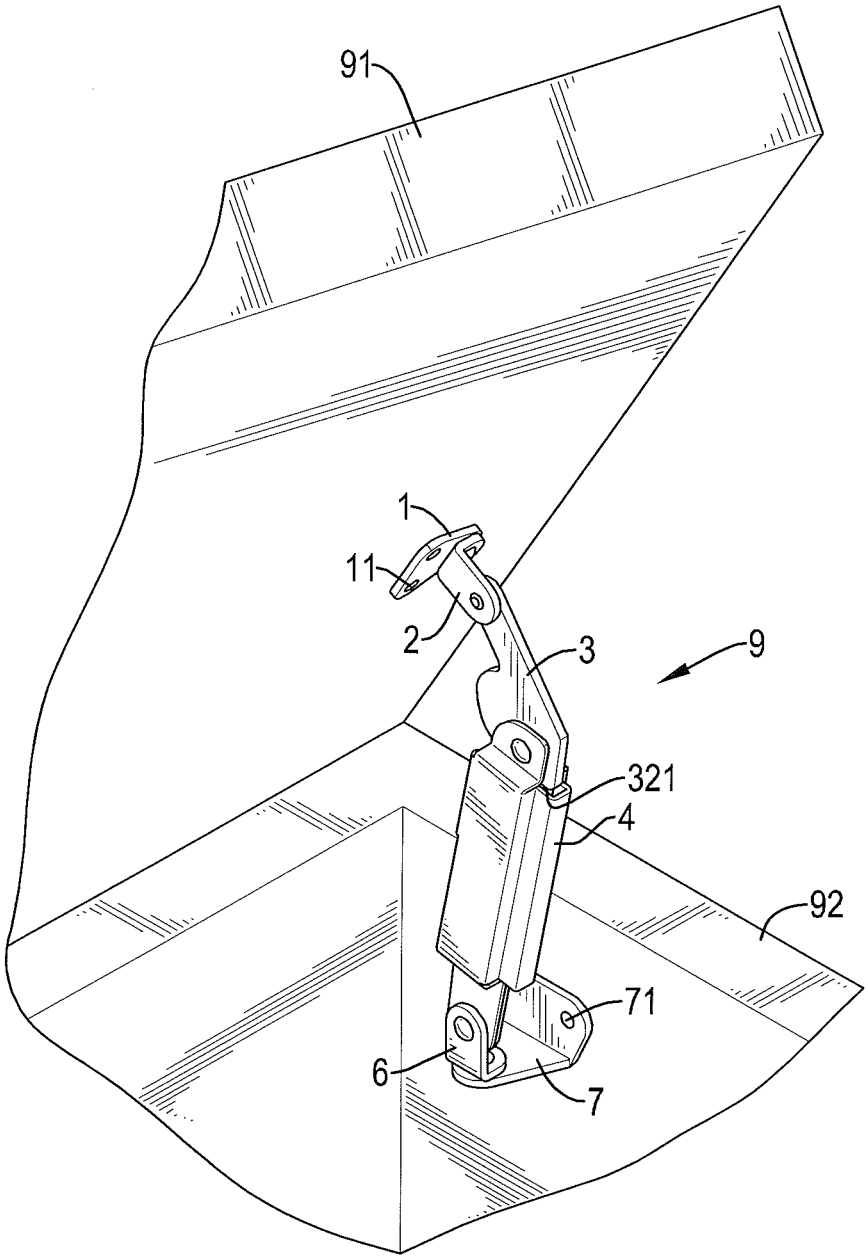
FIG. 5 is another operational perspective view of the universal box lid lifter in FIG. 1, shown mounted in a box.
Figure 6:
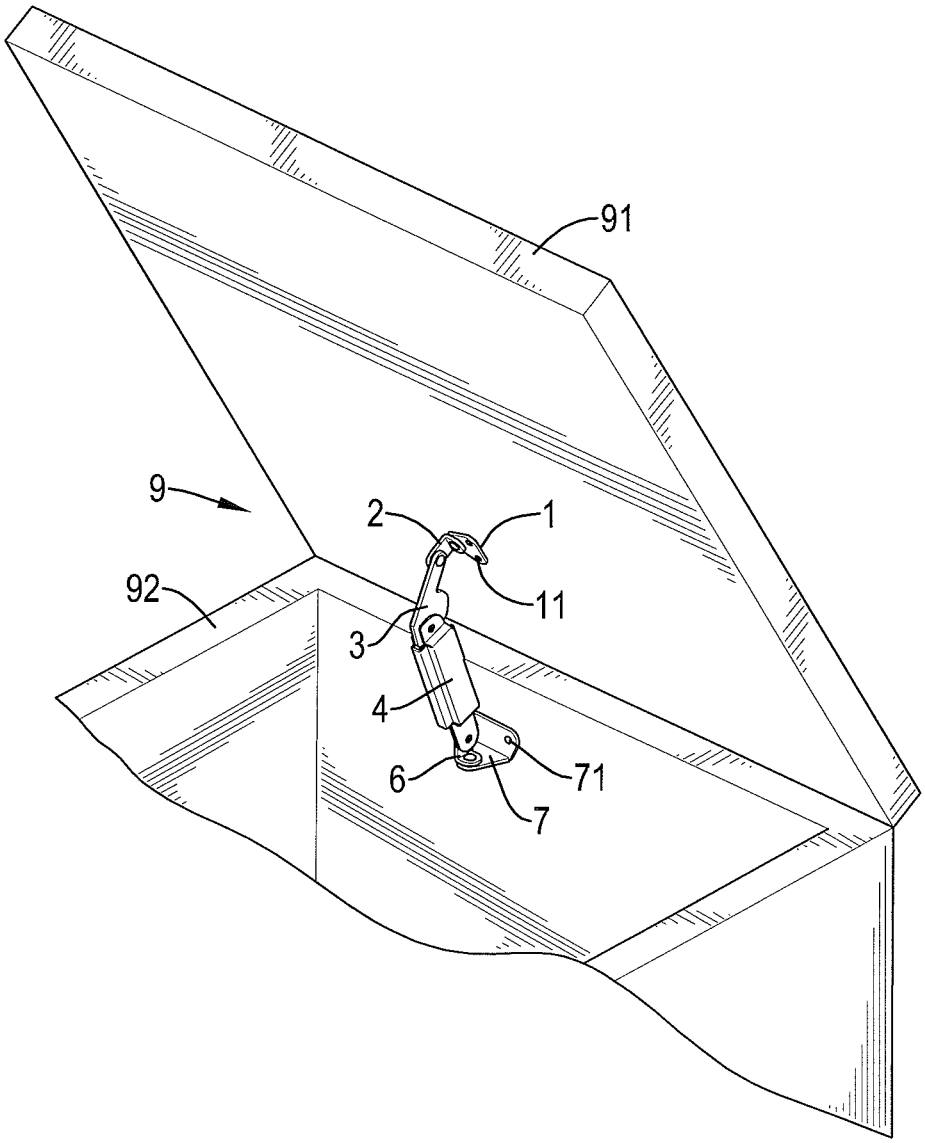
FIG. 6 is a further operational perspective view of the universal box lid lifter in FIG. 1, shown mounted in a box.
Figure 7:
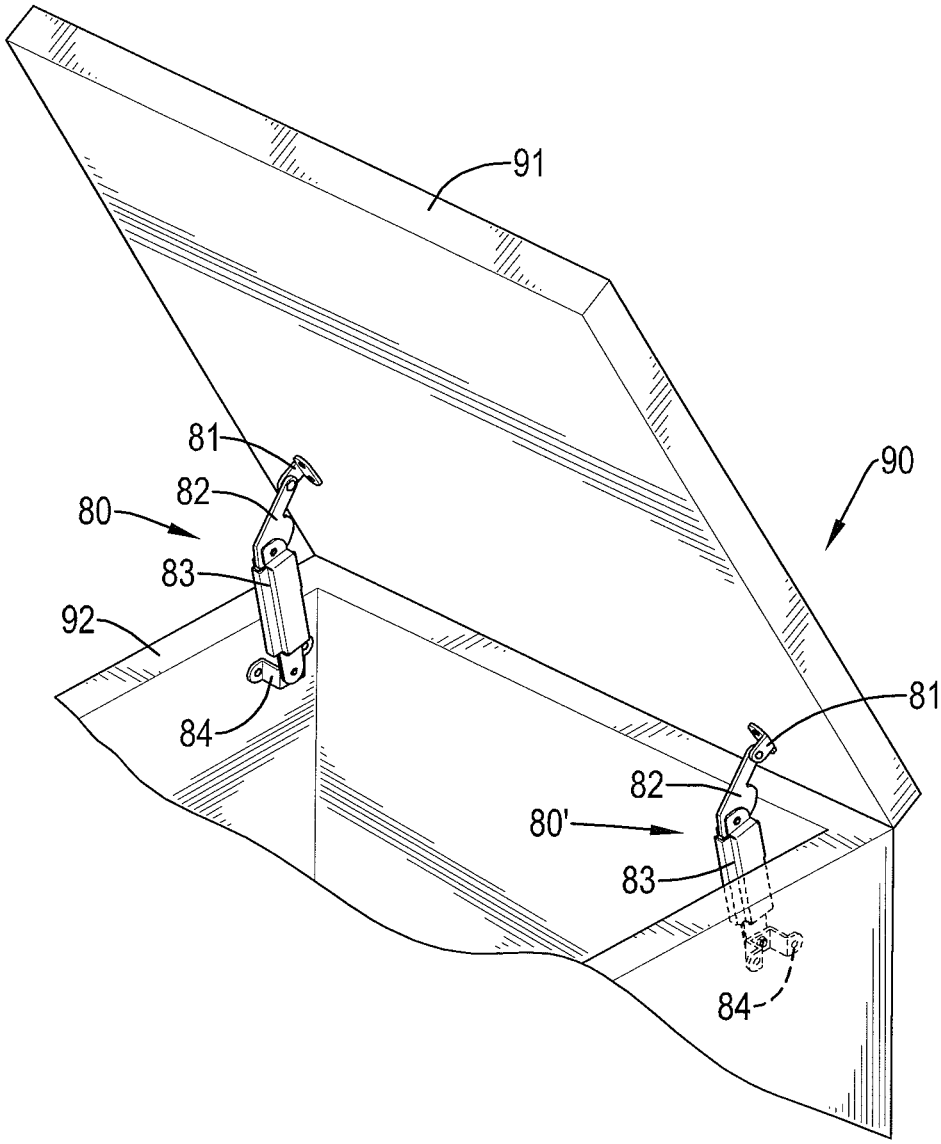
FIG.7 PRIOR ART
FIG. 7 is a perspective view of conventional box lid lifters, shown mounted in a box.

With reference to FIGS. 4 to 6, how the universal box lid lifter can be mounted on different positions in a box 9 having a lid 91 and a base 92 is described as follows.

For mounting the universal box lid lifter, the pivoting arm 3 is first pivoted so that the lifting edge 321 of the pivoting arm 3 abuts against and is securely connected with the spring stop 51 of the spring assembly 5. With reference to FIG. 4, the universal box lid lifter is mounted on an inner wall of the lid 91 and a left inner wall of the base 92. The upper mounting plate 1, the upper connection piece 2, the lower mounting plate 7 and the lower connection piece 6 are pivoted so that the threaded holes 11, 71 of the upper mounting plate 1 and the lower mounting plate 7 respectively face the inner wall of the lid 91 and the left inner wall of the base 92 as shown in FIG. 4. The upper mounting plate 1 and the lower mounting plate 7 are respectively mounted on the lid 91 and the left inner wall of the base 92 by screws to accomplish the mounting of the universal box lid lifter.

With reference to FIG. 5, the universal box lid lifter is mounted on an inner wall of the lid 91 and a right inner wall of the base 92. The upper mounting plate 1, the upper connection piece 2, the lower mounting plate 7 and the lower connection piece 6 are pivoted so that the threaded holes 11, 71 of the upper mounting plate 1 and the lower mounting plate 7 respectively face the inner wall of the lid 91 and the right inner wall of the base 92 as shown in FIG. 5. The upper mounting plate 1 and the lower mounting plate 7 are respectively mounted on the lid 91 and the right inner wall of the base 92 by screws to accomplish the mounting of the universal box lid lifter.

With reference to FIG. 6, the universal box lid lifter is mounted on an inner wall of the lid 91 and a rear inner wall of the base 92. The upper mounting plate 1, the upper connection piece 2, the lower mounting plate 7 and the lower connection piece 6 are pivoted so that the threaded holes 11, 71 of the upper mounting plate 1 and the lower mounting plate 7 respectively face the inner wall of the lid 91 and the rear inner wall of the base 92 as shown in FIG. 6. The upper mounting plate 1 and the lower mounting plate 7 are respectively mounted on the lid 91 and the rear inner wall of the base 92 by screws to accomplish the mounting of the universal box lid lifter.

When the lid 91 is closed, the weight of the lid 91 automatically pushes the pivoting arm 3 of each universal box lid lifter to pivot, and the closing edge 322 of the pivoting arm 3 abuts against and is securely connected with the spring stop 51. Thus, the lid 91 is smoothly closed on the base 92.

Because each of the upper mounting plate 1 and the lower mounting plate 7 can be bidirectionally pivoted respectively relative to the upper connection piece 2 and the lower connection piece 6, the universal box lid lifter can be universally mounted on a lid 91 and different positions on a base 92 of a box 9 for lifting and closing the lid 91. Accordingly, the universal box lid lifter reduces production cost, inventory stocking pressure and mounting efforts.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A universal box lid lifter comprising:

an upper mounting plate;

an upper connection piece having two ends oriented in two different directions, wherein one end of the upper connection piece is pivotally mounted on the upper mounting plate;

a pivoting arm having:

a first end pivotally mounted on the other end of the upper connection piece; and a second end;

a spring housing having:

a first end movably mounted on the second end of the pivoting arm; and a second end;

a spring assembly mounted in the spring housing, abutting against and alternately positioning the second end of the pivoting arm;

a lower connection piece having two ends oriented in two different directions, wherein one end of the lower connection piece is pivotally mounted on the second end of the spring housing; and a lower mounting plate pivotally mounted on the other end of the lower connection piece.

2. The universal box lid lifter as claimed in claim 1, wherein the spring assembly has:

a spring stop having:

a first side abutting against the pivoting arm; and a second side;

a positioning rod securely connected with the second side of the spring stop; and a compression spring mounted around the positioning rod, wherein one end of the compression spring abuts against the second side of the spring stop, and another end of the compression spring abuts against a bottom of an inner wall of the spring housing.

3. The universal box lid lifter as claimed in claim 2, wherein the spring housing further has:

an open side; and two fences formed on two edges of the open side and extending toward each other to block the spring housing and prevent the spring housing from coming off the open side.

4. The universal box lid lifter as claimed in claim 3, wherein the pivoting arm has a sliding slot formed through the second end of the pivoting arm, wherein the pivoting arm is movably mounted on the spring housing through the sliding slot, and wherein the pivoting arm is slidably moved along the sliding slot with respect to the first end of the spring housing.

5. The universal box lid lifter as claimed in claim 4, wherein the pivoting arm has a positioning portion formed on the second end of the pivoting arm and having a lifting edge and a closing edge, and wherein when the pivoting arm is pivoted, the first side of the spring stop alternately abuts against the lifting edge and the closing edge of the pivoting arm for positioning the universal box lid lifter.

6. The universal box lid lifter as claimed in claim 5, wherein an included angle defined by the lifting edge and the closing edge is 90°.

7. The universal box lid lifter as claimed in claim 3, wherein the pivoting arm has a positioning portion formed on the second end of the pivoting arm and having a lifting edge and a closing edge, and wherein when the pivoting arm is pivoted, the first side of the spring stop alternately abuts against the lifting edge and the closing edge of the pivoting arm for positioning the universal box lid lifter.

8. The universal box lid lifter as claimed in claim 7, wherein an included angle defined by the lifting edge and the closing edge is 90°.

9. The universal box lid lifter as claimed in claim 2, wherein the pivoting arm has a sliding slot formed through the second end of the pivoting arm, wherein the pivoting arm is movably mounted on the spring housing through the sliding slot, and wherein the pivoting arm is slidably moved along the sliding slot with respect to the first end of the spring housing.

10. The universal box lid lifter as claimed in claim 9, wherein the pivoting arm has a positioning portion formed on the second end of the pivoting arm and having a lifting edge and a closing edge, and wherein when the pivoting arm is pivoted, the first side of the spring stop alternately abuts against the lifting edge and the closing edge of the pivoting arm for positioning the universal box lid lifter.

11. The universal box lid lifter as claimed in claim 10, wherein an included angle defined by the lifting edge and the closing edge is 90°.

12. The universal box lid lifter as claimed in claim 2, wherein the pivoting arm has a positioning portion formed on the second end of the pivoting arm and having a lifting edge and a closing edge, and wherein when the pivoting arm is pivoted, the first side of the spring stop alternately abuts against the lifting edge and the closing edge of the pivoting arm for positioning the pivoting arm.

13. The universal box lid lifter as claimed in claim 12, wherein an included angle defined by the lifting edge and the closing edge is 90°.

14. The universal box lid lifter as claimed in claim 1, wherein the pivoting arm has a sliding slot formed through the second end of the pivoting arm, wherein the pivoting arm is movably mounted on the spring housing through the sliding slot, and wherein the pivoting arm is slidably moved along the sliding slot with respect to the first end of the spring housing.

15. The universal box lid lifter as claimed in claim 14, wherein the pivoting arm has a positioning portion formed on the second end of the pivoting arm and having a lifting edge and a closing edge, and wherein when the pivoting arm is pivoted, a first side of a spring stop alternately abuts against the lifting edge and the closing edge of the pivoting arm for positioning the universal box lid lifter.

16. The universal box lid lifter as claimed in claim 15, wherein an included angle defined by the lifting edge and the closing edge is 90°.

* * * * *